United States Patent [19]

Saunders

[11] 4,003,167

[45] Jan. 18, 1977

[54] CABIN CONSTRUCTION

[76] Inventor: Reginald E. Saunders, 620 W. Diamond St., Philadelphia, Pa. 19122

[22] Filed: Mar. 3, 1975

[21] Appl. No.: 554,455

[52] U.S. Cl. ..... 52/92; 52/70; 52/262; 52/668; 52/90; 49/19; 49/21

[51] Int. Cl.[2] ..... E04B 7/02; E04C 2/42

[58] Field of Search ..... 52/92, 90, 262, 264, 52/668, 70; 46/12, 19, 20, 21

[56] References Cited

UNITED STATES PATENTS

| | | | |
|---|---|---|---|
| 1,277,766 | 9/1918 | Stadelman | 52/90 |
| 1,459,761 | 6/1923 | Andrews | 52/92 |
| 1,779,325 | 10/1930 | Manning | 52/92 |
| 2,762,084 | 9/1956 | Singer | 52/92 |
| 2,951,311 | 9/1960 | Luther | 46/19 |
| 3,012,291 | 12/1961 | Rice | 52/90 |
| 3,206,903 | 9/1965 | Johnson | 52/92 |
| 3,228,137 | 1/1966 | Runser | 46/19 |
| 3,236,014 | 2/1966 | Edgar | 52/92 |
| 3,308,583 | 3/1967 | Chaney | 52/92 |
| 3,500,597 | 3/1970 | McKenzie | 52/92 |
| 3,735,549 | 5/1973 | Shuart | 52/274 |
| 3,817,011 | 6/1974 | Weed | 52/593 |

FOREIGN PATENTS OR APPLICATIONS

| | | | |
|---|---|---|---|
| 581,411 | 10/1946 | United Kingdom | 52/264 |

*Primary Examiner*—Price C. Faw, Jr.
*Assistant Examiner*—Robert C. Farber
*Attorney, Agent, or Firm*—Weiser, Stapler & Spivak

[57] ABSTRACT

A lightweight cabin construction fabricated of a plurality of readily available lumber and plywood parts. The parts are worked to render them easily interfitting. All of the cabin construction materials may be easily transported in knocked-down condition and are designed to be easily assembled on the job site. The invention also includes a portable foundation which can be employed with the cabin construction for assembly at the job site.

18 Claims, 12 Drawing Figures

FIG. 10
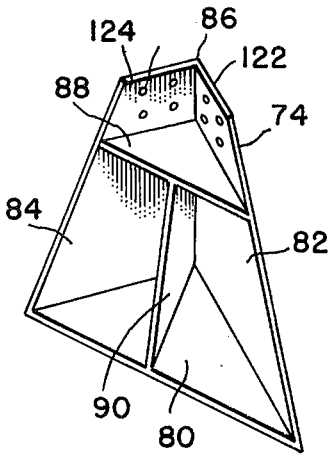
FIG. 11
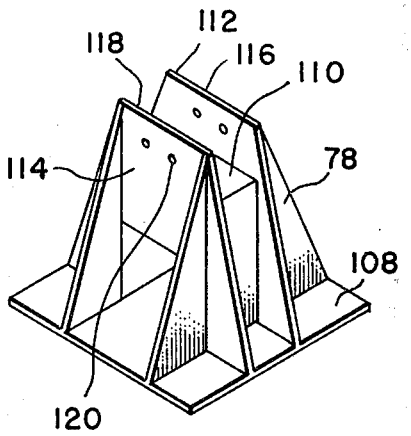
FIG. 12
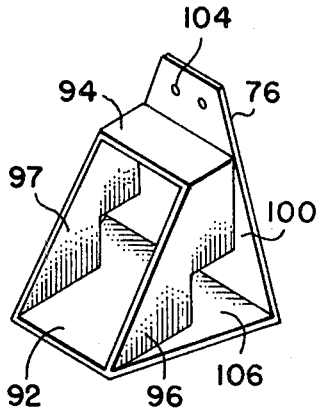
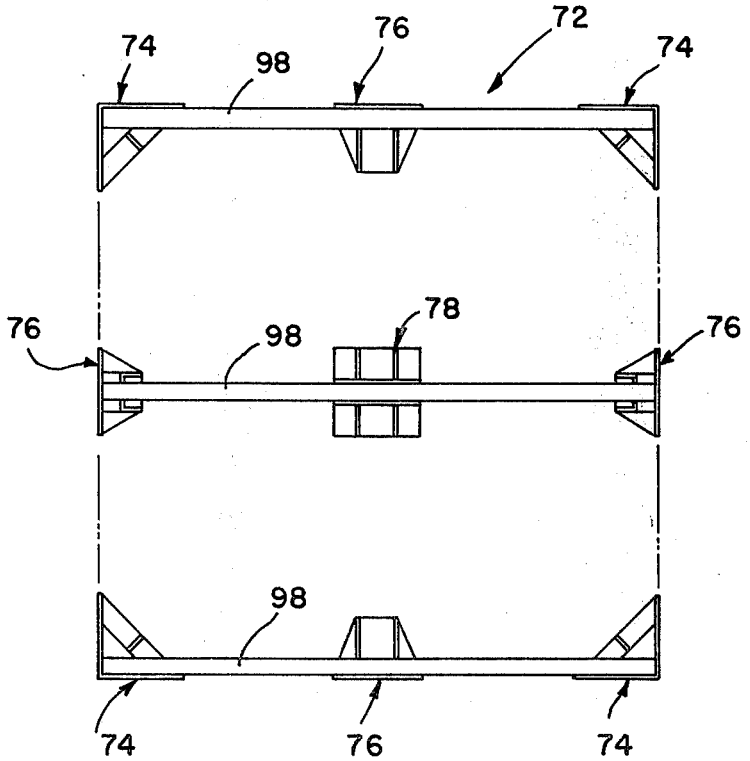
FIG. 9

CABIN CONSTRUCTION

BACKGROUND OF THE INVENTION

This invention relates generally to the field of building construction, and more particularly, is directed to a lightweight, prefabricated cabin construction.

The use of prefabricated type of cabins for a recreational and other temporary use have long been known and many types of prefabricated constructions have been developed by prior workers in the art. The prior constructions usually employ a plurality of structural parts which are factory made and which are specially designed for easy field erection on the job site. All of these prior constructions of which I am familiar employ specially designed construction members which are relatively costly in manufacture and which utilize materials which must be fabricated using special tools and special manufacturing techniques. The prior art types of prefabricated buildings tend to be quite sophisticated in design and accordingly, the parts must be interfitted in the precise manner contemplated without deviating from the basic design concept. Further, it has been found that the prefabricated components of one manufacturer cannot be interchanged with the components of a second manufacturer.

Additionally, problems have arisen when using the prefabricated structural members of prior art designs whenever some portion of the structure has inadvertently been lost, damaged or imperfectly manufactured. In such instances, prior users have found great difficulties and have experienced considerable delays in finding suitable replacement parts to complete the structure.

SUMMARY OF THE INVENTION

The present invention relates generally to the field of lightweight cabin constructions, and more particularly, is directed to a cabin construction which utilizes commonly employed lumber and plywood shapes to provide a plurality of easily interfitting members.

In fabricating a cabin in accordance with the present invention, a plurality of easily available ½ inch thick plywood panels suitable for exterior use are employed. Each plywood panel is drilled to provide a plurality of spaced holes along each vertical edge to permit juxtaposed panels to be overlapped and easily bolted together in the field. Suitable metallic corner pieces are preferably provided to add rigidity at each of the vertical corners. The corner pieces are similarly drilled to provide holes in alignment with the holes drilled in the plywood panels to render the entire assembly subject to easy field erection by employing bolts and nuts in conventional manner. Top notches are provided in the panels to receive the roof rafters therein.

A roof construction is prefabricated by utilizing pairs of ½ inch by 6 inch stock, which are laminated to provide continuous interfitting rafters. Suitable notches are provided in the rafters to interfit with each other for interlocking purposes. The tops of the side plywood panels are notched to provide an easily interlocking construction with the rafters. After assembling all of the wooden structural side panel and roof rafter members to provide an enclosed area, a flexible roofing material may be applied over the rafters, such as a heavy waterproof canvas or vinyl sheet.

By utilizing a plurality of plywood side panels to enclose the cabin, a plurality of doors and windows can be readily formed where desired to make the space suitable for living purposes. Conventional doors and window units can be installed in the door and window openings provided in the plywood panels in well-known manner to provide a complete enclosed space that is readily usable and suitable for the purpose.

If desired, a plurality of interior and exterior base plates can be provided which rest directly upon the ground and which receive therein lumber bracing timbers to support a floor upon which the cabin side walls can be erected.

It is therefore an object of the present invention to provide an improved cabin construction of the type set forth.

It is another object of the present invention to provide a cabin construction which is fabricated of readily available plywood panels and lumber shapes of modular size, all of which are suitable for easy field erection.

It is another object of the present invention to provide a knocked-down type of cabin construction which employs a plurality of interfitting basic shapes which are easily fabricated of readily available materials.

It is another object of the present invention to provide a cabin construction of the knocked-down type which includes a plurality of similar plywood sheets to fabricate the wall panels and a plurality of similar lumber strips which are joined to form the horizontal roof structural members wherein the plywood sheets and the lumber strips can be easily interfitted in the field to provide a lightweight, easily erected cabin.

It is another object of the present invention to provide a novel cabin construction that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 9 is a top plan view of a foundation which may be utilized in conjunction with the construction of FIG. 1.

FIG. 10 is an enlarged perspective view of a corner foundation member.

FIG. 11 is an enlarged, perspective view of an interior foundation supporting member.

FIG. 12 is an enlarged, perspective view of a foundation exterior wall supporting member.

DESCRIPTION OF THE PREFERRED EMBODIMENT OF THE INVENTION

Figure 4:
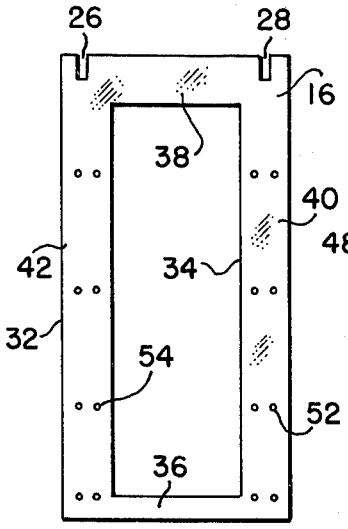
FIG. 4 is a view similar to FIG. 3, showing a side panel treated to accommodate a door.
Figure 5:
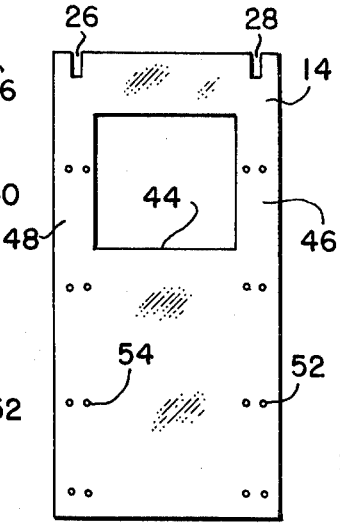
FIG. 5 is a view similar to FIG. 3 showing a panel treated to provide a window opening.

Although specific terms are used in the following description for the sake of clarity, these terms are intended to refer only to the particular structure of my invention selected for illustration in the drawings, and are not intended to define or limit the scope of the invention.

Figure 1:
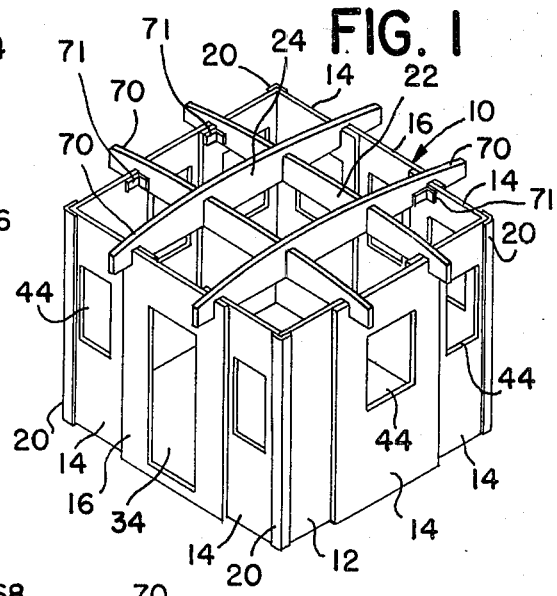
FIG. 1 is a perspective view showing an assembled cabin construction in accordance with the present invention.
Figure 8:
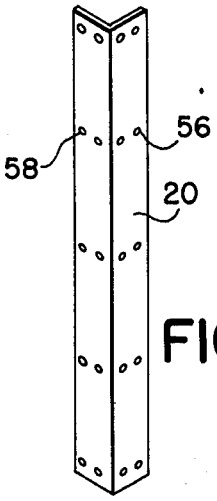
FIG. 8 is a perspective view of a corner reinforcing strip.

Referring now to the drawings, I show in FIG. 1 a cabin construction generally designated 10, which is fabricated of a plurality of plain side panels 12, a number of window side panels 14, and one or more door side panels 16. The panels overlap at the marginal edges thereof to form lap joints 18 of design suitable to permit easy field bolting to secure adjacent panels together. Corner strengthening strips 20 are preferably provided at the cabin corners to form easily field erected corner constructions. A plurality of mutually intersecting transverse and longitudinal rafters 22, 24 affix to the panels 12, 14, 16 at the top edges thereof to provide adequate support to carry a roof (not shown) thereon.

In order to prefabricate the parts for the cabin 10, I prefer to employ 12 or more 4 feet × 8 feet ½ inch thick plywood panels suitable for exterior construction. Each panel is preferably cut in the shop to the dimensions of 40 inches by 84 inches. All of the panels 12, 14, 16 are then provided with similar top notches 26, 28 which are similarly positioned and which serve to receive and lock the longitudinal and transverse rafters 22, 24 when the cabin is erected. In the preferred embodiment, all of the notches 26, 28 are cut 1 inch in width and 4 inches in depth and extend inwardly from a point 2½ inches from the right and left marginal panel edges 30, 32. One or more of the panels should be selected for use as a door panel 16, one or more of the panels should be selected for use as window side panels 14 and the remainder should be left plain for use as the plain side panels 12.

Each door side panel 16 is cut to provide a door opening 34, preferably 73 inches in height and 24 inches in width, the door opening 34 being so positioned as to provide a 3 inch sill 36, an 8 inch head 38 and similar right and left side overlap strips 40, 42 each 8 inches in width. The panels selected as window side panels 14 are preferably cut to provide window openings 44 that are 24 inches in height and 22 inches in width. The window openings 44 are so positioned as to provide right and left overlap strips 46, 48 of 9 inches in width and a head 50 of 12 inches in height. The 24 inch by 22 inch window dimensions have been chosen to accommodate readily available manufactured window units such as window units manufactured by American Enclosure Co., which can be readily field clipped into the openings 44 thus provided.

All of the panels 12, 14, 16 are provided with a plurality of similarly positioned pairs of right and left bolt holes 52, 54 which are spaced vertically on 2 foot centers and horizontally 3 inches apart. The outermost hole of each pair of holes 52, 54 is positioned approximately 1½ inches from its adjacent panel edge 30, 32. The holes 52, 54 are preferably one-quarter inch holes which completely penetrate the respective panels 12, 14, 16 and are designed to receive ¼ inch by 1½ inch bolts therein during the assembly process. A plurality of four corner reinforcing angles 20 are employed and are preferably fabricated of ⅛ inch by 2 inch by 84 inch polished aluminum, vertically folded to form two angularly oriented legs. The legs of the corner reinforcing angles 20 are provided with a plurality of pairs of openings 56, 58 which are positioned to overlie and register with the pairs of bolt holes 52, 54 provided in each of the panels 12, 14, 16.

In order to assemble the side panels of the cabin construction 10, the panels 12, 14, 16 are arranged vertically in edge overlapping relationship with the window panels 14, the door panels 16 and the plain side panels 12 arranged as desired, for example as shown in FIG. 1. Once the desired arrangement of panels has been established, adjacent panels are placed in edge overlapping relationship to form lap joints 18. In this arrangement, the right pair of bolt holes 52 of one panel align over and register with the left pair of bolt holes 54 of the next adjacent panel. When the holes 52, 54 are in registry, suitable one-quarter inch bolts (not shown) together with washers and wing nuts (not shown) are then associated with the holes 52, 54 in the usual manner to securely attach adjacent panels together. The corner reinforcing strips 20 are provided at each of the corners (see FIGS. 1 and 2) and are positioned so that the pairs of angle openings 56, 58 register over the end pairs of bolt holes 52, 54 of the side panels 12 or 14 which form the corner construction. A sufficient number of bolts (not shown) are employed to secure all of the registered pairs of bolt holes 52, 54 and angle openings 56, 58 together.

Figure 6:
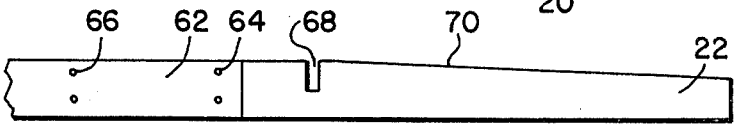
FIG. 6 is an enlarged, partial, side elevational view showing the rafter construction.
Figure 7:
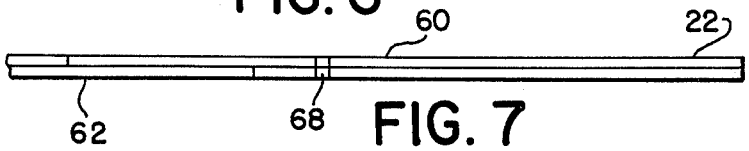
FIG. 7 is a top plan view of the rafter of FIG. 6, looking from Line 7—7 in the direction of the arrows.
Figure 3:
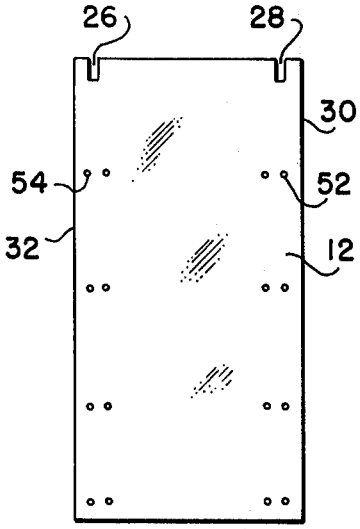
FIG. 3 is a side elevational view of a plain side panel.

In order to fabricate the roof rafter construction, the longitudinal rafters 22 and transverse rafters 24 are laminated by utilizing a plurality of pieces of ½ inch by 6 inch stock lumber. In the configuration illustrated, two boards 60 that are 6 six feet in length and two boards 62 that are 4 feed in length are employed for each rafter. The rafter boards 60, 62 are screw laminated together to form continuous rafters that are 1 inch in width, 6 inches in depth and 10 feet in length. Pairs of suitably positioned ¼ inch bolt holes 64, 66 are provided in the boards 60, 62 to facilitate laminating the boards 60, 62 together in the overlapping areas by aligning the respective pairs of holes 64, 66 and then inserting bolts (not shown) therethrough and securing the bolts in place conventionally by employing suitable nuts and washers (not shown) in well known manner. The rafters 22, 24 are provided with notches 68 at all intersections 70 to interlock the longitudinal rafters 22 with the transverse rafters 24 to form an extremely sturdy, inexpensive, readily field assembled type of roof construction. Preferably the rafter ends are bevelled downwardly at the ends 70 thereof to facilitate attaching the roof construction (not shown). See FIG. 6.

Figure 2:
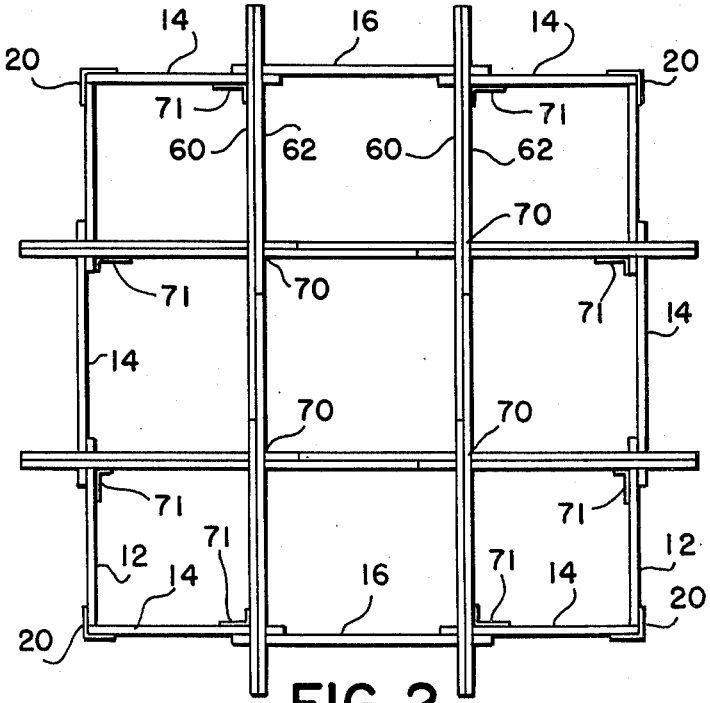
FIG. 2 is an enlarged, top plan view of the cabin construction of FIG. 1.

After the longitudinal and transverse roof rafters 22, 24 have been laminated together and assembled to form the grid pattern as illustrated in FIG. 2, the rafters can then be affixed to the cabin side construction panels 12, 14, 16 by applying the bottoms of the rafters into the various notches 26, 28 which have been provided at the respective tops of the panels. Strap hinges 71 can be employed to secure the rafters to the panels. See FIGS. 1 and 2. After the rafters 22, 24 have been inserted to the full depth (for example, 4 inches) of the top notches 26, 28, an extremely strong, easily erected cabin construction 10 has been developed. A flexible roof (not shown) which may be fabricated of canvas or of suitable heavy sheet plastic is then applied over the rafters 22, 24 and is securely tied thereto to provide a watertight covering for the cabin 10. If desired, the perimeter of the canvas or sheet plastic roof can be provided with a plurality of spaced holes suitably reinforced with grommets (not shown) to permit the roofing material to be affixed directly to the side panels 12, 14, 16 at the uppermost pairs of bolt holes 52, 54 by employing the same bolts which are utilized to secure adjacent side panels together by inserting them through the grommets (not shown). If desired, a floor tarp which is similar in size and construction to the roof canvas or plastic (not shown) can be employed to cover the floor of the cabin.

After the perimeter of the cabin and the roof of the cabin have been secured in place, suitable door or doors (not shown) can be affixed to cover the door opening 34 in conventional manner. Similarly, the window openings 44 can then be enclosed with standard window units (not shown) to thereby provide a relatively secure, inexpensive and weather tight cabin construction.

Referring now to FIGS. 9, 10, 11 and 12, I show a foundation system 72 which is portable in nature and which may be employed in conjunction with the cabin construction 10, if so desired. In constructing the foundation system 72, I employ a plurality of base plates 74, 76, 78 which are preferably fabricated of one-quarter inch aluminum and which are suitably welded to fabricate the corner base plates 74, the interior base plates 76 and the side base plates 78.

Referring now to FIGS. 9 and 10, I show a corner base plate 74 which is fabricated with a horizontal ground contacting base member 80 and a pair of angularly intersecting side plates 82, 84 which extend upwardly from the ground contacting base member 80 and form a right angular corner 86. The side plates extend upwardly to form the flanges 122, 124 which may be drilled to provide openings for fastening floor beams. A horizontal shelf 88 is spaced above the base member 80 and is welded or otherwise joined to the side plates 82, 84 to form a sturdy floor beam receiving area. If desired, a vertical reinforcing member 90 extending upwardly from the base member 80 can be employed to additionally support the shelf 88. One corner base plate 74 is provided at each corner of the cabin construction as best seen in FIG. 9. It will be noted that the base plates 74, 76, 78 can be placed directly upon the ground surface for cabin support purposes. Optionally, concrete footings (not shown) could first be conventionally installed in the ground and then the individual base plates installed over the footings.

Intermediate the corner base plates 74 along the cabin sidewalls thereof are positioned intermediate base plates 76 which are similarly formed of one-quarter inch aluminum plate and which include a ground contacting base member 92. A shelf 94 is spaced above the ground contacting member 92 and is secured in position by the right and left carriers 96, 98 in a sturdy manner such as by welding all of the junctions between members. The shelf 94 of the intermediate base plate 76 is carried exactly the same distance above its ground contacting base 92 as is the shelf 88 of the corner base plate 74 above its respective base member 80. In this manner, floor beams 98 such as four inch by four inch stock lumber members can be adequately supported by positioning a floor beam 98 on the respective shelves 88 of the corner base plates 74 and on the shelf 94 of one or more intermediate base plates 76. As best seen in FIG. 12, each intermediate base plate 76 includes an enclosing side 100 which extends above the shelf 94 a sufficient distance to provide a side flange 102. Bolt holes 104 may be provided in the side flange 102 to facilitate securing the floor beam 98 to the base plate 76 by using conventional fasteners (not shown) therethrough in well known manner. As illustrated, the right and left carriers 96, 97 can be cut to provide notched areas 106 to permit base beams (not illustrated) which can be similar to the floor beams 98 to be extended beneath the floor beams 98 to additionally support the foundation system.

Referring now to FIGS. 9 and 11, I show an interior base plate 78 which is similarly fabricated of aluminum plate and which includes a ground contacting base member 108 and a shelf 110 which is adequately supported and spaced above the base member 108. It is noteworthy that the shelf 110 is maintained the same distance above the base member 108 as is the shelf 88 above its base member 80 and the shelf 94 above its base member 92 of the respective corner base plates 74 and the intermediate base plates 76. In this manner, all of the floor beams 98 will be supported the same distance above the ground to thereby provide a stable and level floor system for the cabin construction 10.

The shelf 110 is welded or otherwise secured to the right and left carriers 112, 114 in welded junction which are fabricated of sufficient strength to support the load. The right and left carriers 112, 114 extend above the shelf 110 to form right and left flanges 116, 118 to secure the floor beam 98 therebetween. Suitable openings 120 are provided in the flanges to permit fasteners (not shown) to pass therethrough to secure the floor beam 98 to the interior base plate 78 in well known manner. It is noteworthy that the flanges 116, 118 of the interior base plate 78, the side flanges 102 of the intermediate base plate 76 and the corner flanges 122, 124 of the corner base plates 74 are all of equal height and of a height equal to the height of the floor beams 98. Thus, if the floor beams 98 are four inches in height, then all of the flanges 102, 116, 118, 122 and 124 will also be fabricated four inches in height to provide a uniform height limitation to all floor construction members. After the respective base plates 74, 76, 78 have been positioned as in FIG. 9 and the respective floor beams 98 have been longitudinally arranged and secured to the respective base plates by employing fasteners inserted through the respective flange openings 104 (FIG. 12), 120 (FIG. 11) and 126 (FIG. 10) any suitable floor planking (not illustrated) may be transversely laid over the respective floor beams 98 and can be secured thereto in conventional manner such as by employing wood screws or nails (not illustrated) to thereby provide a strong, easily erected wooden floor system for the cabin construction.

By fabricating the foundation system 72 as illustrated in FIG. 9, the cabin construction 10 of FIG. 1 can be built directly upon the foundation system 72 to thereby provide an elevated sturdy base construction rather than simply employing the ground as the floor if so desired.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited to the foregoing specification, but rather only by the scope of the claims appended hereto.

I claim:

1. In a cabin construction, the combination of

A. a plurality of side panels arranged in vertical edge-overlapping relationship to form a cabin side, 1. each side panel having a first edge, a second edge, and a top edge, a. at least some of said side panels being provided with a plurality of vertically spaced holes, a first plurality of said holes being spaced inwardly from the first edge and a second plurality of said holes being spaced inwardly from the second edge, b. the first edge of at least one panel overlapping and being joined to the second edge of the next adjacent side panel, c. at least some of said first plurality of holes being aligned with some of said second plurality of holes of an adjacent panel to receive fasteners therethrough;

B. a plurality of cabin sides being arranged in edge to edge relationship to define an enclosed space; and C. a plurality of roof rafters arranged in parallel and intersecting relationship, 1. the roof rafters resting upon and being supported by at least some of said side panels at the top edges thereof, 2. the roof rafters defining the top margins of the said enclosed space.

2. The cabin construction of claim 1 wherein at least some of the side panels are provided with notches at the top edges, said notches being upwardly open, and wherein portions of a roof rafter position into a notch to lock the roof rafters to the cabin sides.

3. The cabin construction in accordance with claim 2 wherein at least some of the notches are positioned in the overlapping area of adjacent panels.

4. The cabin construction in accordance with claim 2 at least some of said side panels are provided with two said notches, said notches being inwardly spaced from the panel first and second edges approximately the same distance as the said holes.

5. The cabin construction in accordance with claim 1 and means to interconnect the said cabin sides at the respective edges thereof.

6. The cabin construction of claim 5 wherein the means to interconnect comprises an angle reinforcing strip, said strip being interconnected between adjacent cabin sides.

7. The cabin construction of claim 6 wherein the legs of the reinforcing strip are provided with a plurality of vertically spaced openings, at least some of the said openings aligning with some of the panel holes for joining adjacent cabin sides in angular relationship.

8. The cabin construction of claim 7 and fasteners to join the strip to the panels of two cabin sides at at least some of the said vertically spaced holes.

9. The cabin construction according to claim 1 wherein the rafters are formed of at least two members laminated together, said members forming a vertical joint therebetween to define two sides for each rafter.

10. The cabin construction of claim 9 wherein each rafter side comprises a first board and a second board, the first board being longer than the second board.

11. The cabin construction of claim 10 wherein the first board of one side overlies the entire second board of the other side to form offset junctions.

12. The cabin construction of claim 1 and portable foundation means positioned below the cabin sides to support the cabin construction above the ground.

13. The cabin construction in accordance with claim 12 wherein the foundation means comprises a plurality of base plates, and a plurality of beams supported by said base plates, said beams carrying the weight of the cabin construction in spaced relation above ground level, the said base plates being positioned to rest upon the ground surface.

14. The cabin construction of claim 13 wherein at least some of the base plates includes a planar base member in contact with the ground surface and shelf means held in spaced relation above the base members, portions of the beams resting upon the shelf means to support the beams above the base members.

15. The cabin construction of claim 14 wherein at least some of the base plates include flange means to retain the said beams.

16. The cabin construction in accordance with claim 15 wherein the flange means include flanges rising above the shelf means, said flanges intersecting the shelf means at right angles.

17. The cabin construction of claim 16 wherein at least some of the flange means are provided with openings and fasteners inserted through the openings, said fasteners entering the beams to secure the beams to the base plates.

18. The cabin construction of claim 14 wherein some of the shelf means are endwardly open to receive an intermediate portion of a beam and other of said shelf means are endwardly closed to support an end portion of a beam.

* * * * *